US007573443B2

(12) United States Patent
Oh

(10) Patent No.: US 7,573,443 B2
(45) Date of Patent: Aug. 11, 2009

(54) ELECTRO-LUMINESCENCE DISPLAY DEVICE AND DRIVING METHOD THEREOF

(75) Inventor: Du Hwan Oh, Cheongju-si (KR)

(73) Assignee: LG. Display Co., Ltd., Seoul (KR)

( * ) Notice: Subject to any disclaimer, the term of this patent is extended or adjusted under 35 U.S.C. 154(b) by 660 days.

(21) Appl. No.: 11/168,951

(22) Filed: Jun. 28, 2005

(65) Prior Publication Data

US 2006/0071883 A1 Apr. 6, 2006

(30) Foreign Application Priority Data

Oct. 6, 2004 (KR) ..... 10-2004-0079539

(51) Int. Cl.
*G09G 3/30* (2006.01)

(52) U.S. Cl. ..... 345/76

(58) Field of Classification Search ..... 345/76–79, 345/45, 36, 82–83, 204; 315/169.3
See application file for complete search history.

(56) References Cited

U.S. PATENT DOCUMENTS 5,883,531 A * 3/1999 Kuo ..... 327/108
6,753,655 B2 * 6/2004 Shih et al. ..... 315/169.3
7,009,591 B2 * 3/2006 Shibusawa ..... 345/76
2003/0098657 A1 5/2003 Suzuki
2004/0052368 A1 3/2004 Spring et al.
2004/0189884 A1 9/2004 Kim et al.
2005/0093464 A1 * 5/2005 Shin et al. ..... 315/169.1
2005/0243037 A1 * 11/2005 Eom et al. ..... 345/76

FOREIGN PATENT DOCUMENTS

WO WO 03/077230 9/2003

OTHER PUBLICATIONS

Combined Search and Examination Report for corresponding United Kingdom Patent Application Serial No. GB0513328.5, dated Sep. 23, 2005.
Notification of First Office Action for corresponing Chinese Patent Application Serial No. 2005100801871, dated Nov. 30, 2007.

* cited by examiner

*Primary Examiner*—Amr Awad
*Assistant Examiner*—Liliana Cerullo
(74) *Attorney, Agent, or Firm*—Brinks Hofer Gilson & Lione

(57) ABSTRACT

An electro-luminescence display device includes a plurality of column lines, a plurality of first row lines and a plurality of second row lines. The plurality of first row lines cross the column lines and a first scan signal is supplied thereto. The plurality of second row lines intersects the column lines and a second scan signal is supplied thereto. Organic light emitting devices are formed at pixel areas which are defined by the column lines and the first and second row lines. At least two drive switches operate to drive the organic light emitting devices. The second scan signal applies later than the first scan signal to activate the drive switches. A kickback voltage is generated upon a voltage change of the first row line. A kickback compensation circuit operates to cancel the kick-back voltage.

11 Claims, 11 Drawing Sheets

ELECTRO-LUMINESCENCE DISPLAY DEVICE AND DRIVING METHOD THEREOF

This application claims the benefit of the Korean Patent Application No. P2004-79539 filed on Oct. 6, 2004, which is hereby incorporated by reference.

BACKGROUND

1. Field of the Invention

The invention relates to an electro-luminescence display device, and more particularly, to a current-driven type electro-luminescence display device.

2. Description of the Related Art

Various flat panel display devices having a lightweight and a compact size have replaced a cathode ray tube (CRT). The flat panel display devices include a liquid crystal display (LCD), a field emission display (FED), a plasma display panel (PDP), an electro-luminescence (EL) display, an organic light emitting display (OLED) and so on.

The OLED is classified into a passive matrix and an active matrix. The active matrix OLED includes a thin film transistor, whereas the passive matrix has no thin film transistor. The active matrix OLED (AMOLED) is more suitable for a display device having a large size and a high resolution. The OLED is a self-luminous display device which electrically excites a fluorescent organic compound to emit light. It operates at low voltage and is thinner than other flat display devices. Further, the OLED has excellent characteristics such as a wide viewing angle and a rapid response speed. The OLED is currently in use for various devices, such as a hand phone, a car navigation, a hand PC and etc.

FIG. 1 is a circuit diagram illustrating a pixel structure of a current-driven type electro-luminescence display device of the related art. Referring to FIG. 1, the current-driven type electro-luminescence display device 100 includes an electro-luminescence ("EL"), a switch part 10 and a data line. The EL forms a pixel in accordance with the current strength. The switch part 10 includes switches S/W1, S/W2 and S/W3 and controls the current supplied to the EL. The data line DATA and first and second scan lines Scan1, Scan2 supply a signal to the switch part 10.

The first switch S/W1 includes a drain that is connected to the data line DATA and a gate that is connected to the first scan line Scan1. The second switch S/W2 has a gate that is connected to the first scan line Scan1 and a drain that is connected to a source of the first switch S/W1. A storage capacitor Cstg is arranged between a high potential voltage VDD and a source of the second switch S/W2. A drive transistor D-TFT has a gate that is connected between the storage capacitor Cstg and the source of the second switch S/W2 and a source that is connected to the high potential voltage VDD. The third switch S/W3 includes a gate that is connected to the second scan line Scan2 and the source is connected to a drain of the drive transistor D-TFT. The EL is connected between a drain of the third switch S/W3 and a ground GND.

FIG. 2 illustrates a drive waveform for the electro-luminescence display device 100 of FIG. 1. In an interval A of FIG. 2, a low voltage applies to the first scan line Scan1. The first switch S/W1 and the second switch S/W2 are turned on. When the first and second switches S/W1, S/W2 are turned on, the drive transistor D-TFT forms a diode connection. The current sinks to the data line DATA through the drive transistor D-TFT.

In an interval B, the first and second switches S/W1 and S/W2 are turned-off and the drive transistor D-TFT is turned on by a storage capacitor Cstg. The third switch S/W3 is turned on with a low voltage supplied to the second scan line Scan2 so that a current corresponding to a designated data value flows in the EL for one frame period.

FIG. 3 illustrates parasitic capacitors which are hidden in the electro-luminescence display device 100. A first parasitic capacitor C1 is formed between the gate and source of the second switch S/W2. A second parasitic capacitor is formed between the source of the second switch S/W2 and the source of the third switch S/W3. A third parasitic capacitor C3 is formed between the gate and the source of the third switch S/W3. Due to the influence of the parasitic capacitors C1, C2 and C3, when the first switch and the second switch S/W1, S/W2 are turned off, a DC voltage offset is generated and a kickback effect occurs. The kickback effect occurs in particular where the first and second switches S/W1, S/W2 are turned off and the third switch S/W3 is turned on.

Referring to FIG. 4, a kickback voltage develops in the first parasitic capacitor C1 by as much as ΔVp1 in a direction of increasing the gate voltage of the drive transistor D-TFT. A kickback voltage also develops in the third parasitic capacitor C3 by as much as ΔVp2 in a direction of decreasing the gate voltage of the drive transistor D-TFT. As a result, the kickback voltage may not be entirely cancelled and a voltage difference by "D" is generated. The voltages ΔVp1 and ΔVp2 are computed with the following equation (2):

$$\Delta Vp1 = \frac{C1}{C1 + C2 + C3 + Cstg} \times \Delta Vgs1 \quad \text{(Equation 1)}$$

$$\Delta Vp2 = \frac{C2 + C3}{C1 + C2 + C3 + Cstg} \times \Delta Vgs3 \quad \text{(Equation 2)}$$

where ΔVgs1 is a change amount of a threshold voltage between the gate and the source of the first switch S/W1, and ΔVgs3 is a change amount of a threshold voltage between the gate and the source of the third switch S/W3.

The kickback effect may result in a non-uniformity of a picture quality. A displayed picture appears inconsistent and uneven in accordance with its characteristics. Accordingly, there is a need of a current-driven type electro-luminescence display device which provides an improved uniformity of a picture quality.

SUMMARY OF THE INVENTION

By way of introduction only, an electro-luminescence display device includes a plurality of column lines, a plurality of first row lines, and a plurality of second row lines. The plurality of first row lines intersect the column lines and a first scan signal is supplied thereto. The plurality of second row lines intersects the column lines and a second scan signal is supplied thereto. The second scan signal is later than the first scan signal. Organic light emitting devices are formed at pixel areas. The pixel areas are defined by the column lines and the first and second row lines. The electro-luminescence display device includes at least two drive switches and a compensation circuit which operates to be complementary to each other with the drive switch. The compensation circuit operates to compensate a kickback voltage generated upon a voltage change of the first row line. In one embodiment, the compensation circuit operates to generate an offset kickback voltage upon a voltage change of the second row line.

A driving method of an electro-luminescence display device includes installing a kickback compensation circuit adjacent a drive switches, and compensating a kickback voltage which is generated upon a voltage change of the first row line by use of the kickback compensation circuit.

BRIEF DESCRIPTION OF THE DRAWINGS

The following detailed description of the embodiments reference the accompanying drawings, in which.

DETAILED DESCRIPTION OF THE PREFERRED EMBODIMENT

Figure 5:
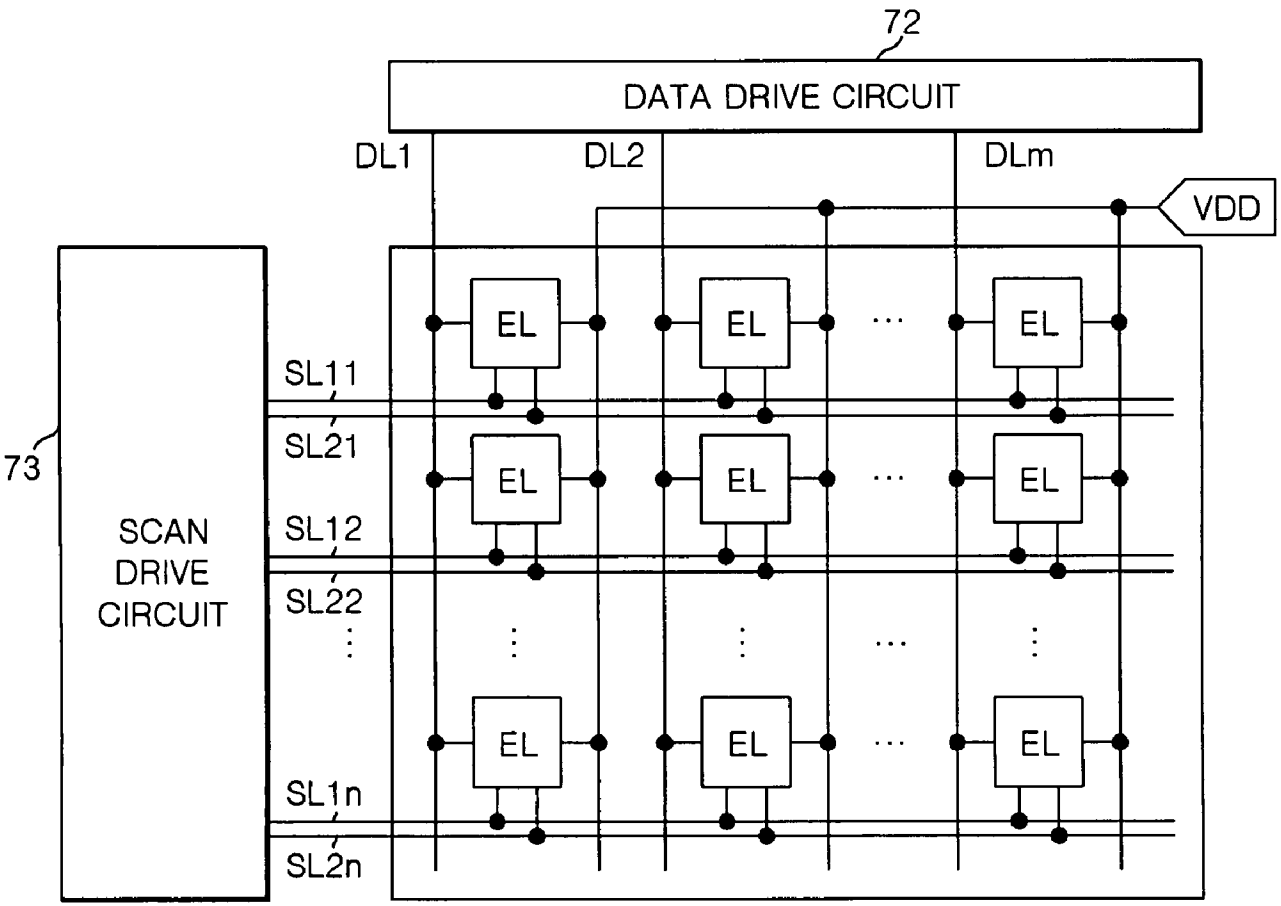
FIG. 5 is a block diagram of a current-driven type electro-luminescence display device.

FIG. 5 is a block diagram illustrating a current-driven type electro-luminescence display device 500. Referring to FIG. 5, the current-driven type electro-luminescence display device 500 includes m×n numbers of pixels which are arranged in a matrix pattern. A pixel area is formed between m numbers of data lines DL1 to DLm and n numbers of first and second scan lines Scan11 to Scan1*n* and second scan lines Scan21 to Scan2*n*. A data drive circuit 72 supplies a data to the data lines DL1 to DLm and a scan drive circuit 73 sequentially supplies a scan signal to the first and second scan lines Scan11 to Scan1*n*, Scan21 to Scan2*n*.

Figure 6A:
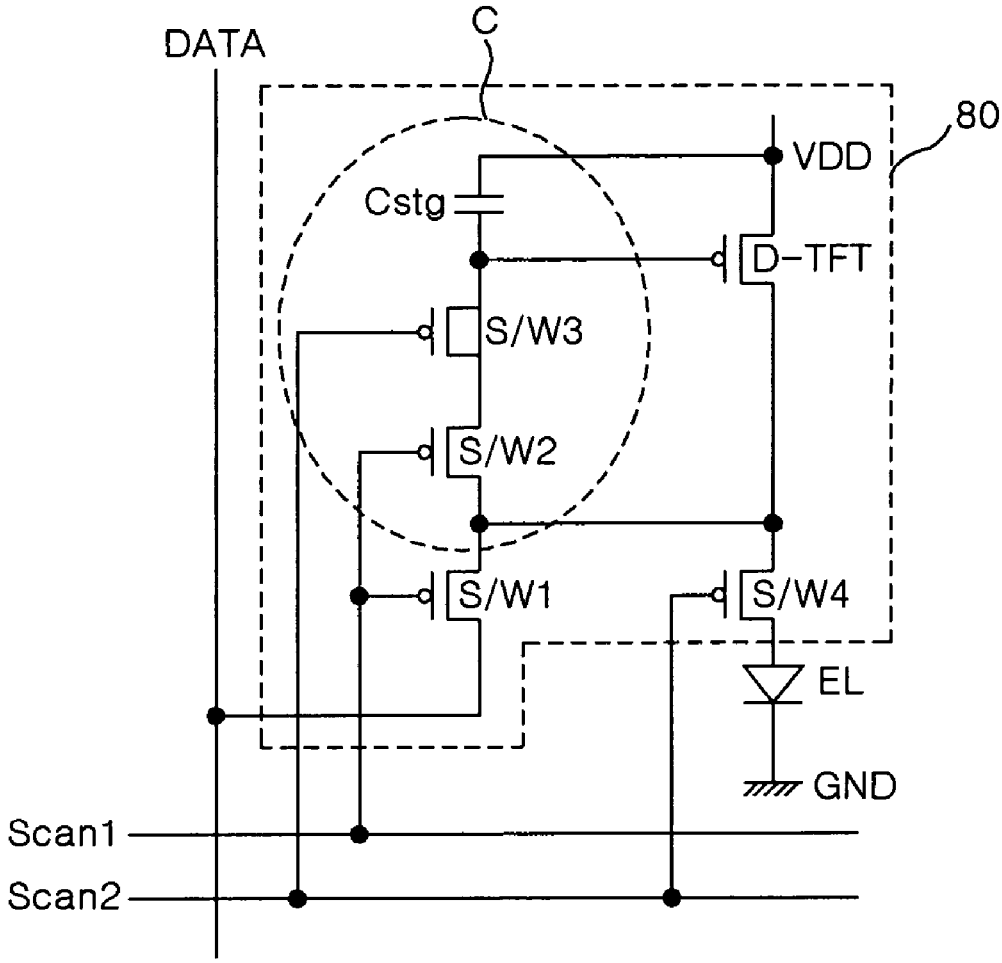
FIGS. 6A and 6B are circuit diagrams representing a pixel structure in the electro-luminescence display device of FIG. 5.
Figure 6B:
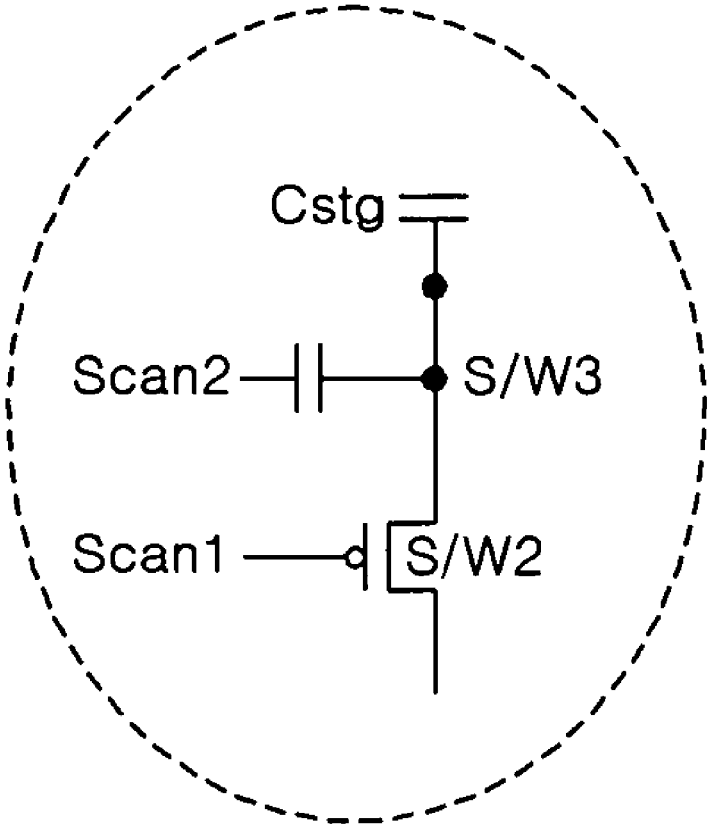

A pixel structure of the current-driven type electro-luminescence display device 500 will be described in detail in conjunction with FIGS. 6A and 6B. Referring to FIG. 6A, the pixel structure includes a data line DL, first and second scan lines Scan1 and Scan2 and a drive switch 80 to drive pixels. The drive switch 80 includes a storage capacitor Cstg.

The drive switch 80 includes a first switch S/W1, a second switch S/W2, a third switch S/W3, a fourth switch S/W4 and a storage capacitor. In the first switch S/W1, a drain is connected to the data line DL and a gate is connected to the first scan line Scan1. In the second switch S/W2, a gate is connected to the first scan line Scan1 and a drain is connected to a source of the first switch S/W1. In the third switch S/W3, a gate is connected to the second scan line Scan2 and a drain is connected to the source of the second switch S/W2. The storage capacitor Cstg is arranged between a high potential voltage VDD and a source of the third switch S/W3. The drive switch 80 includes a drive transistor D-TFT of which a gate is connected between the storage capacitor Cstg and the source of the third switch S/W3. A source of the drive transistor D-TFT is connected to the high potential voltage VDD. The driver switch 80 further includes a fourth switch S/W4 of which a gate is connected to the second scan line Scan2 and a source is connected to the drain of the drive transistor D-TFT. An EL is connected between a drain of the fourth switch S/W4 and a ground GND. The source and the drain of the third switch S/W3 are connected to each other. With that arrangement, the third switch S/W3 may be equivalent to a capacitor as shown in FIG. 6B.

The drive transistor D-TFT operates in a self compensation method which compensates a voltage by itself with the storage capacitor Cstg. The storage capacitor Cstg is connected between the gate and the source of the transistor D-TFT. Accordingly, in the current-driven type electro-luminescence display device 500, a current corresponding to a designated data value equally flows in each EL regardless of the characteristics change of the drive transistor device of an adjacent pixel. Further, such data value is sustained for one frame period after the first and second switches S/W1, S/W2 are turned off by charging a data voltage in the storage capacitor Cstg.

Figure 1:
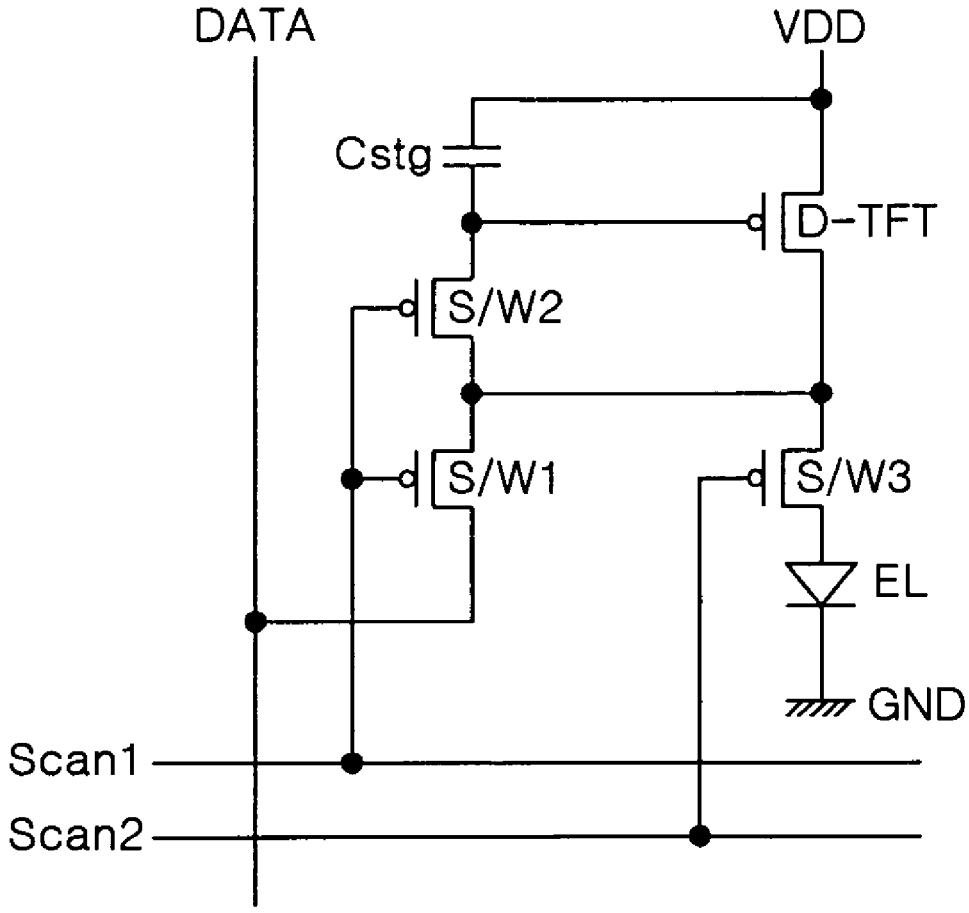
FIG. 1 RELATED ART
FIG. 1 is a circuit diagram representing a pixel area of a related art current-driven type electro-luminescence display device.
Figure 2:
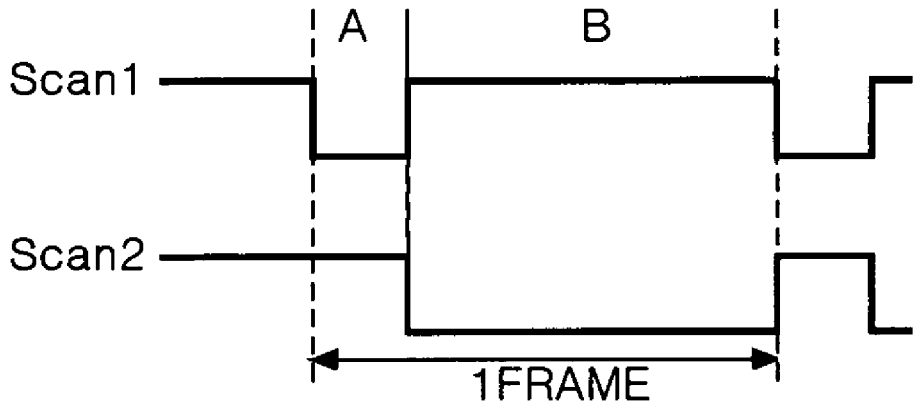
FIG.2 RELATED ART
FIG. 2 illustrates a drive waveform for the electro-luminescence display device of FIG. 1.
Figure 3:
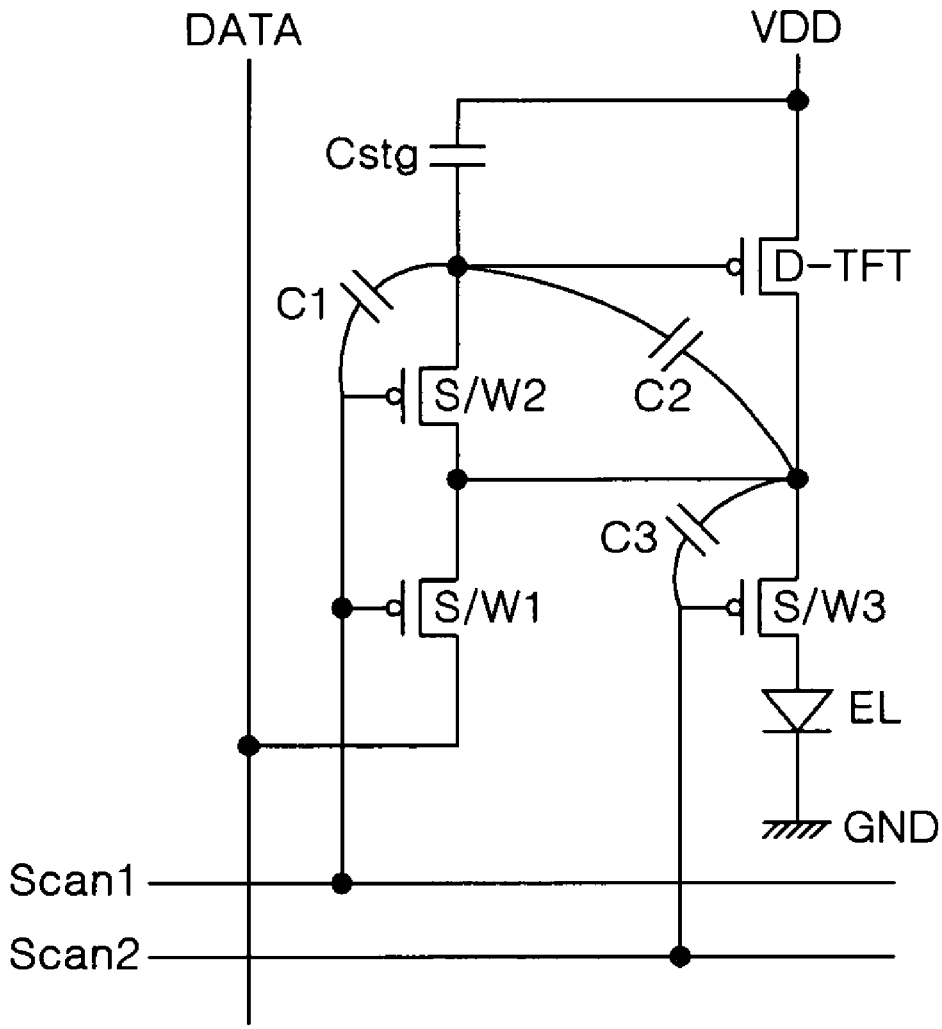
FIG. 3 RELATED ART
FIG. 3 illustrates parasitic capacitors in the electro-luminescence display device of FIG. 1.
Figure 4:
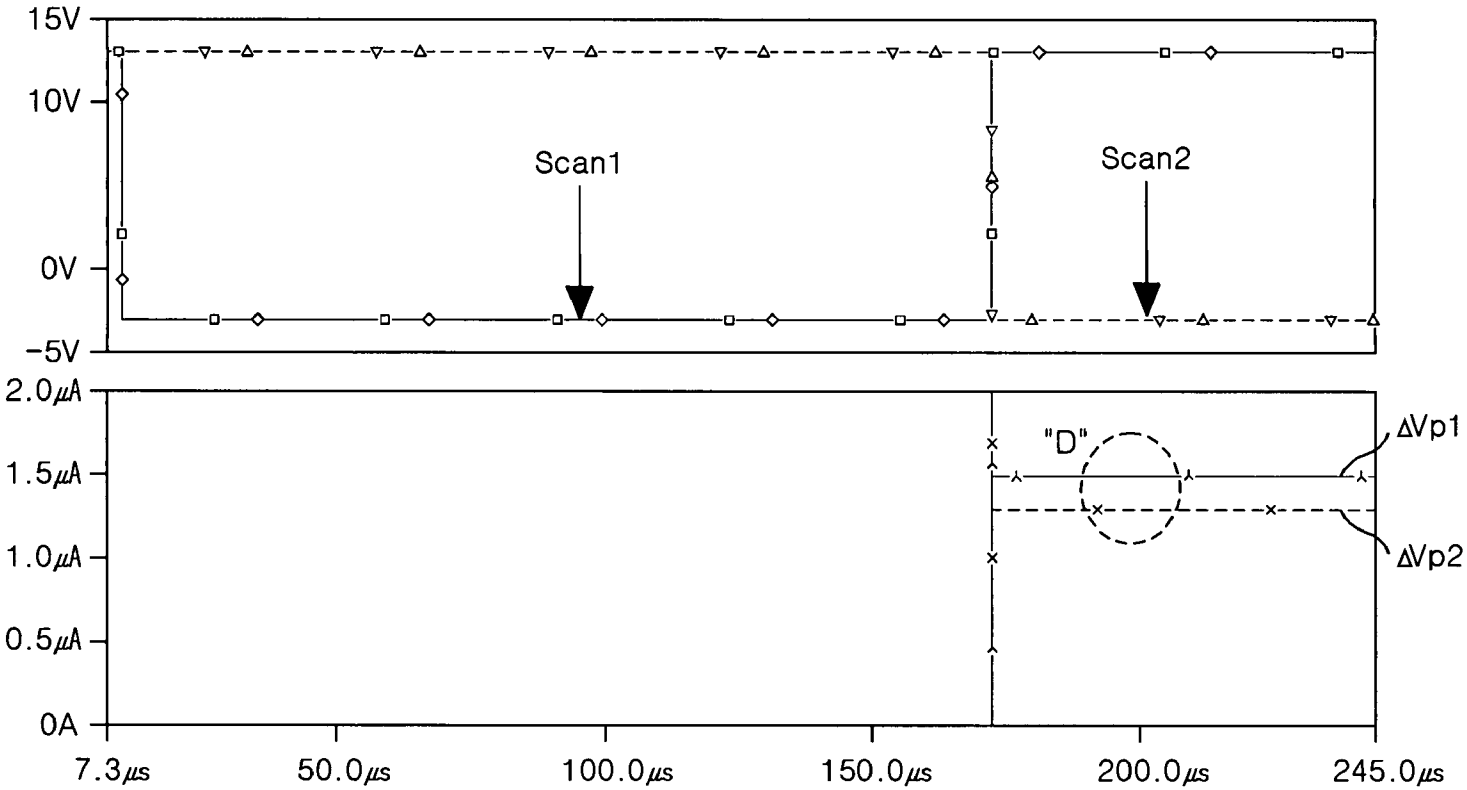
FIG. 4 RELATED ART
FIG. 4 is a chart illustrating a voltage change in connection with the electro-luminescence display device of FIG. 3.
Figure 7:
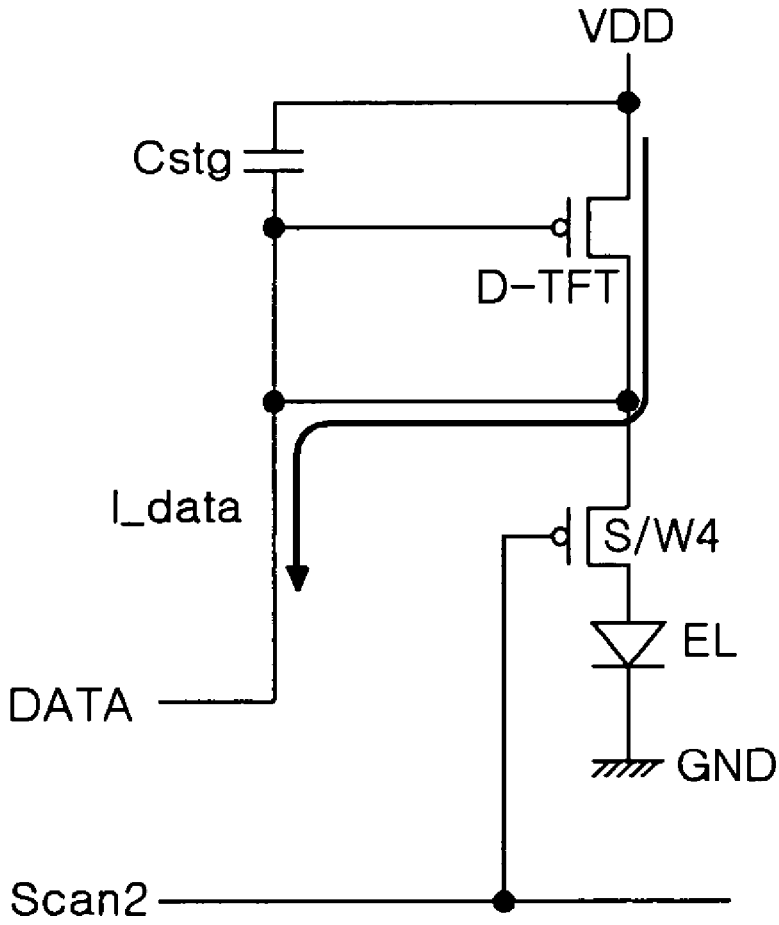
FIG. 7 illustrates a signal flow via a first scan line.

A driving method of the current-driven type electro-luminescence display device will be described in conjunction with FIGS. 6A to 8. As noted above, FIG. 2 illustrates the drive waveform for use with the electro-luminescence display device. In the A period, the high potential voltage VDD applies to the first scan line Scan1. The first and second switches S/W1, S/W2 are turned on as shown in FIG. 7. At this time, a high potential voltage VDD is charged in the storage capacitor Cstg and a current subsequently flows through a path formed by the first and second switches S/W1 and S/W2. The voltage sinks at the data line through the first switch S/W1 via the drive transistor D-TFT by as much as the potential difference between the high potential voltage VDD and the voltage which remains in the storage capacitor Cstg. For example, electric charge stored in the storage capacitor Cstg is 2V and the high potential voltage VDD is 10V. The remaining voltage, i.e., 8V flows through the drive transistor D-TFT and the voltage sinks to the data line through the first switch S/W1.

Figure 8:
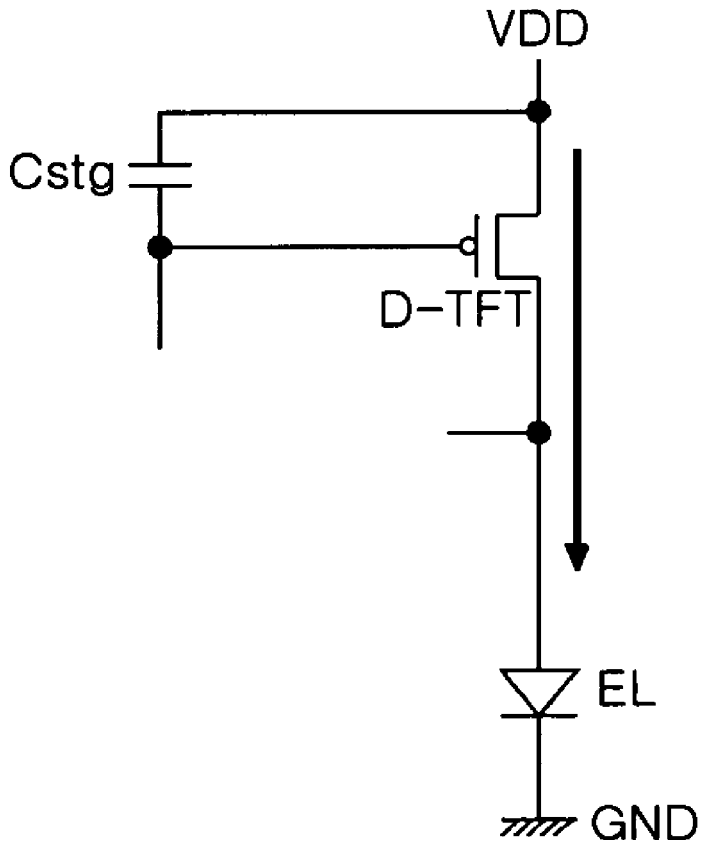
FIG. 8 illustrates a signal flow via a second scan line.

In the B period, the high potential voltage VDD flows in the EL through the fourth switch S/W4 as shown in FIG. 8 and at this moment, the designated current activates the EL for operation. While the voltage supplied to the first scan line Scan1 is changed from a low voltage to a high voltage, the voltage supplied to the second scan line Scan2 is changed from the high voltage to the low voltage. Accordingly, the first and second switches S/W1, S/W2 are turned off and the third and fourth switches S/W3, S/W4 are turned on. The second scan signal operates to activate the drive switch later than the first scan signal. The high, potential voltage VDD is supplied to the EL through the drive transistor D-TFT via the fourth switch S/W4 for a period except for the A period within one frame period. The designated current flows in the EL from the high potential voltage VDD.

Figure 9:
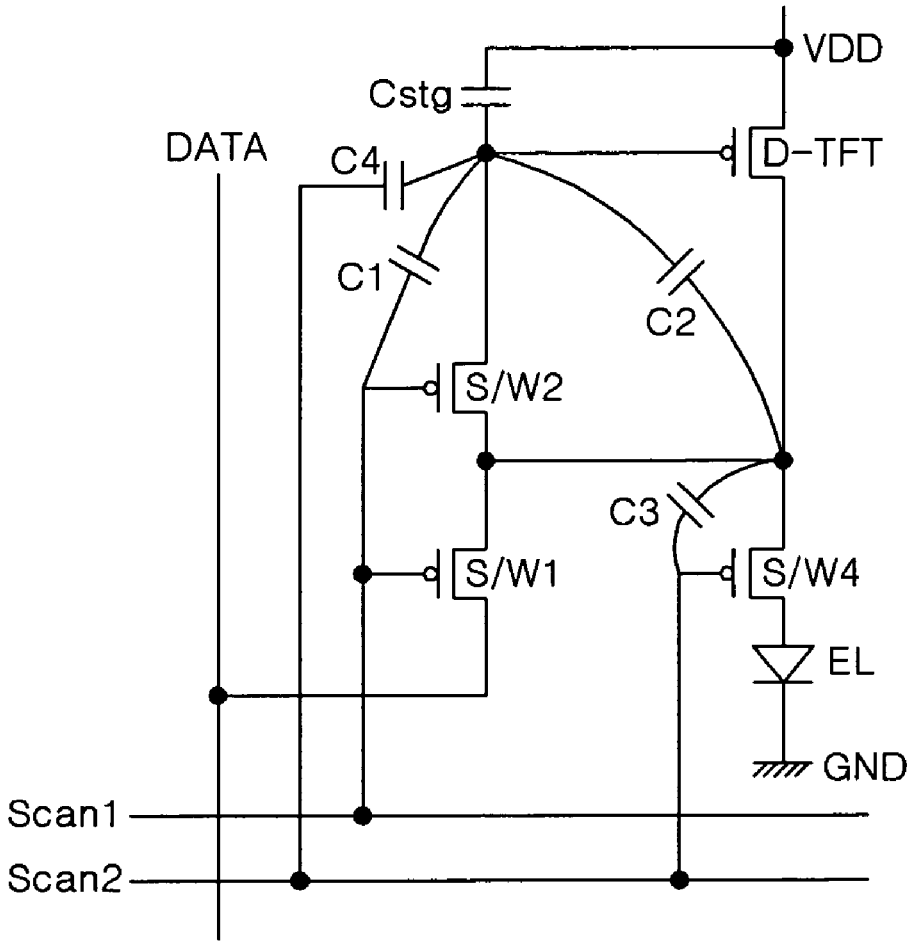
FIG. 9 illustrates parasitic capacitors in connection with the pixel structure of FIG. 6A.

FIG. 9 illustrates parasitic capacitors of the current-driven type electro-luminescence display device. Referring to FIG. 9, the parasitic capacitors includes a first parasitic capacitor C1, a second parasitic capacitor C2, a third parasitic capacitor C3 and a fourth parasitic capacitor C4. The first parasitic capacitor C1 is formed between the gate and the source of the second switch S/W2. The second parasitic capacitor C2 is formed between the source of the second switch S/W2 and the source of the fourth switch S/W4. The third parasitic capacitor C3 is formed between the source of the second switch S/W2 and the second scan line Scan2. A fourth parasitic capacitor C4 is formed between the gate and the source of the fourth switch S/W4.

Figure 10:
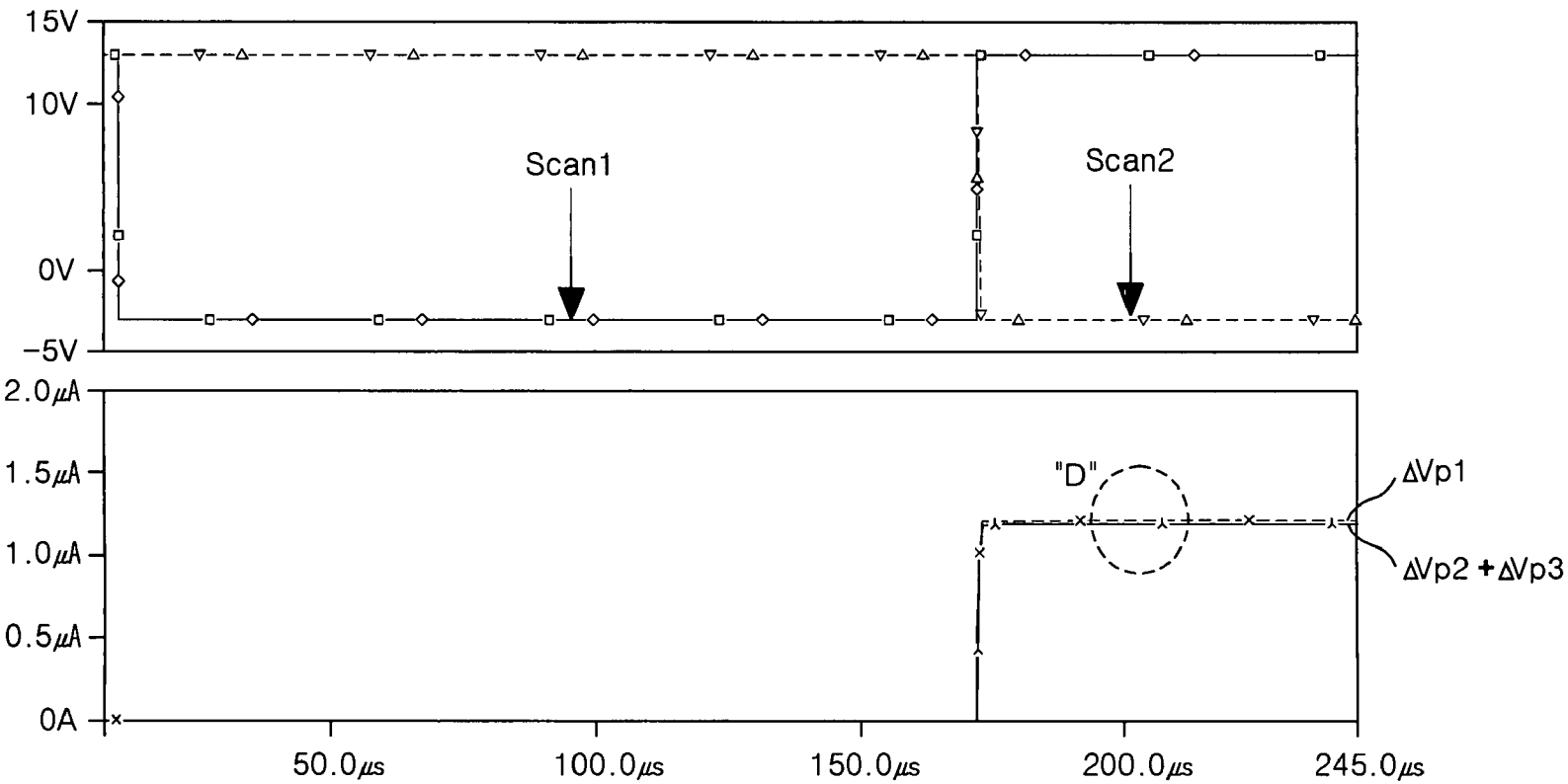
FIG. 10 illustrates a voltage change amount in connection with the parasitic capacitors of FIG. 9.

When the first and second switches S/W1, S/W2 are turned off, a kickback effect is generated by the first parasitic capacitor C1 in a direction of increasing the gate voltage of the drive transistor D-TFT. This kickback effect cancels off another kickback effect which is generated by the third and fourth parasitic capacitors C3, C4 in a direction of decreasing the gate voltage of the drive transistor D-TFT as a whole. The kickback voltage is generated in the first parasitic capacitor C1 by as much as ΔVp1 in a direction of increasing the gate voltage of the drive transistor D-TFT. The kickback voltage is also generated in the third parasitic capacitor C3 by as much as ΔVp3 in a direction of decreasing the gate voltage of the drive transistor D-TFT. Further, the kickback voltage occurs in the fourth parasitic capacitor C4 by as much as ΔVp4 in a direction of decreasing the gate voltage of the drive transistor D-TFT. The kickback voltage is cancelled off as a whole, as shown in FIG. 10. The third switch S/W3 may be determined to be a value that may cancel off the kickback effect which is generated with the first and second switches S/W1, S/W2.

The kickback voltage represented by ΔVp1, ΔVp3 and ΔVp4 are computed with the following equations:

$$\Delta Vp1 = \frac{C1}{C1 + C2 + C3 + C4 + Cstg} \times \Delta Vgs1 \quad \text{(Equation 3)}$$

$$\Delta Vp3 = \frac{C3}{C1 + C2 + C3 + C4 + Cstg} \times \Delta Vgs3 \quad \text{(Equation 4)}$$

$$\Delta Vp4 = \frac{C2 + C4}{C1 + C2 + C3 + C4 + Cstg} \times \Delta Vgs4 \quad \text{(Equation 5)}$$

wherein ΔVgs1 is a change amount of a threshold voltage between the gate and the source of the first switch S/W1, ΔVgs3 is a change amount of a threshold voltage between the gate and the source of the third switch S/W3, and ΔVgs4 is a change amount of a threshold voltage between the gate and the source of the fourth switch S/W4.

As described above, the current-driven type electro-luminescence display device may prevent the kickback effect of various sizes. Accordingly, the current supplied to the EL may be uniform and the picture quality defect may be prevented. As a result, an overall picture quality may substantially improve.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro-luminescence display device, comprising:

a plurality of column lines;

a plurality of first row lines intersecting the column lines and receiving a first scan signal;

a plurality of second row lines intersecting the column lines and receiving a second scan signal;

an organic light emitting device formed at pixel areas, the pixel areas defined by the plurality of the column lines and the plurality of the first and second row lines; and a drive switch operable to drive the organic light emitting device, wherein the drive switch comprises:

a first switch having a drain terminal connected to the column line, a source terminal connected to a first node, and a gate terminal connected to the first row line;

a second switch having a gate terminal connected to the first row line, a drain electrode connected to the first node, and a source terminal;

a third switch having a gate terminal connected to the second row line, a drain terminal connected to the source terminal of the second switch, and a source terminal connected to a second node and the drain terminal of the third switch;

a drive transistor having a gate terminal connected to the second node, a source terminal to which a high potential voltage is supplied, and a drain terminal connected to the first node;

a fourth switch having a gate terminal connected to the second row line, a source terminal connected to the first node, and a drain terminal connected to a anode terminal of the organic light emitting device; and a storage capacitor having a first terminal connected to the source terminal of the drive transistor, and a second terminal connected to the second node, wherein the third switch forms a compensation capacitor to cancel a kickback voltage generated upon a voltage change of the first row line, wherein the second scan signal operates to activate the drive switch later than the first scan signal.

2. The electro-luminescence display device according to claim 1, wherein the compensation capacitor operates to generate an offset kickback voltage upon a voltage change of the second row line.

3. A method for producing an electro-luminescence display device, comprising:

supplying a column line operating as a data line;

arranging a first row line and a second row line to intersect with the column line wherein the first row line and the second row line operate as a scan line, wherein a first scan signal is supplied to the first row line and a second scan signal is supplied to the second row line;

forming a pixel area defined with the column line, the first row line and the second row line wherein the pixel area comprises an organic light emitting device; and connecting a plurality of drive switches to the column line, the first row line and the second row line wherein the plurality of drive switches operate to drive the organic light emitting device, wherein each of the drive switches comprises:

a first switch having a drain terminal connected to the column line, a source terminal connected to a first node, and a gate terminal connected to the first row line;

a second switch having a gate terminal connected to the first row line, a drain electrode connected to the first node, and a source terminal;

a third switch having a gate terminal connected to the second row line, a drain terminal connected to the source terminal of the second switch, and a source terminal connected to a second node and the drain terminal of the third switch;

a drive transistor having a gate terminal connected to the second node, a source terminal to which a high potential voltage is supplied, and a drain terminal connected to the first node;

a fourth switch having a gate terminal connected to the second row line, a source terminal connected to the first node, and a drain terminal connected to a anode terminal of the organic light emitting device; and a storage capacitor having a first terminal connected to the source terminal of the drive transistor, and a second terminal connected to the second node, wherein the third switch forms a compensation capacitor between the second row line and the second node to cancel a kickback voltage generated upon a voltage change of the first row line.

4. A driving method of an electro-luminescence display device, comprising:

applying a first scan signal to a gate terminal of a first switch and a gate terminal of a second switch, wherein the first switch has a drain terminal connected to a column line to which a data is supplied and a source terminal connected to a first node, wherein the second switch has a drain electrode connected to the first node, and a source terminal;

applying a second scan signal to a gate terminal of a third switch and a gate terminal of a fourth switch, wherein the third switch has a drain terminal connected to the source terminal of the second switch, and a source terminal connected to a second node and the drain terminal of the third switch to form a compensation capacitor, wherein the fourth switch has a source terminal connected to the first node, and a drain terminal connected to a anode terminal of an organic light emitting device;

activating the third switch and the fourth switch later than the first switch and the second switch;

supplying a high potential voltage to a drive transistor, wherein the drive transistor has a gate terminal connected to the second node, a source terminal to which the high potential voltage is supplied, and a drain terminal connected to the first node, wherein a storage capacitor has a first terminal connected to the source terminal of the drive transistor, and a second terminal connected to the second node;

canceling a kickback voltage generated upon a voltage change of the first scan signal using the compensation capacitor; and activating the organic light emitting device with application of the second scan signal.

5. The driving method of claim 4, further comprising:

generating a first kickback voltage in a direction of increasing a gate voltage of the drive transistor with the first and the second switches;

generating a second kickback voltage in a direction of decreasing the gate voltage of the drive transistor with the third and the fourth switch.

6. The driving method of claim 5, wherein canceling the kickback voltage further comprises canceling the first kickback voltage with the second kickback voltage.

7. The driving method of claim 6, further comprising determining a value for the third switch based on the kickback voltage.

8. The driving method of claim 4, further comprising:

turning on the first switch and the second switch with the first scan signal during a first interval of a frame; and applying the high potential voltage to a data line through a path formed with the first switch and the second switch.

9. The driving method of claim 4, wherein canceling the kickback voltage comprises generating an offset kickback voltage to be complementary to the kickback voltage.

10. The driving method of claim 8, further comprising:

turning off the first switch and the second switch during a second interval of the frame; and turning on the third switch and the fourth switch during the second interval of the frame.

11. The driving method of claim 10, further comprising:

applying the high potential voltage to the organic light emitting device through the fourth switch.

* * * * *

UNITED STATES PATENT AND TRADEMARK OFFICE

CERTIFICATE OF CORRECTION

PATENT NO. : 7,573,443 B2
APPLICATION NO. : 11/168951
DATED : August 11, 2009
INVENTOR(S) : Du Hwan Oh It is certified that error appears in the above-identified patent and that said Letters Patent is hereby corrected as shown below:

On the title page,

[*] Notice: Subject to any disclaimer, the term of this patent is extended or adjusted under 35 USC 154(b) by 660 days.

Delete the phrase "by 660 days" and insert -- by 910 days --

Signed and Sealed this

Thirteenth Day of April, 2010

David J. Kappos

David J. Kappos
*Director of the United States Patent and Trademark Office*